US010239317B2

(12) United States Patent
Tamaru et al.

(10) Patent No.: US 10,239,317 B2
(45) Date of Patent: Mar. 26, 2019

(54) METHOD FOR MANUFACTURING LIQUID DISCHARGE HEAD, LIQUID DISCHARGE HEAD, AND METHOD FOR MANUFACTURING LIQUID DISCHARGE HEAD SUBSTRATE

(71) Applicant: CANON KABUSHIKI KAISHA, Tokyo (JP)

(72) Inventors: Yuji Tamaru, Yokohama (JP); Yuichiro Akama, Tokyo (JP); Naoko Tsujiuchi, Kawasaki (JP); Sayaka Seki, Tokyo (JP); Yasuaki Kitayama, Yokohama (JP); Yusuke Hashimoto, Yokohama (JP); Takanobu Manabe, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/659,506

(22) Filed: Jul. 25, 2017

(65) Prior Publication Data

US 2018/0029367 A1 Feb. 1, 2018

(30) Foreign Application Priority Data

Jul. 29, 2016 (JP) ..... 2016-150418

(51) Int. Cl.
*B41J 2/16* (2006.01)

(52) U.S. Cl.
CPC ..... *B41J 2/16* (2013.01); *B41J 2/1603* (2013.01); *B41J 2/1607* (2013.01); *B41J 2/1628* (2013.01); *B41J 2/1629* (2013.01); *B41J 2/1631* (2013.01); *B41J 2/1637* (2013.01); *B41J 2/1639* (2013.01); *B41J 2/1642* (2013.01); *B41J 2/1646* (2013.01); *B41J 2/1604* (2013.01); *B41J 2/1623* (2013.01); *B41J 2/1645* (2013.01)

(58) Field of Classification Search
None
See application file for complete search history.

(56) References Cited

FOREIGN PATENT DOCUMENTS

| | | | | |
|---|---|---|---|---|
| JP | 10-181032 A | | 7/1998 | |
| JP | 2007-160624 A | | 6/2007 | |
| JP | 2007160624 | * | 6/2007 | ..... B41J 2/05 |

* cited by examiner

*Primary Examiner* — Jiong-Ping Lu
(74) *Attorney, Agent, or Firm* — Canon U.S.A., Inc. IP Division

(57) ABSTRACT

There is provided a method for manufacturing a liquid discharge head including a liquid discharge head substrate and a flow path forming member, the liquid discharge head substrate having a base, a pressure generation portion provided at a front surface of the base to generate pressure for discharging a liquid, and a supply port for supplying the liquid to the pressure generation portion, and the flow path forming member forming a flow path for feeding the liquid supplied from the supply port to the pressure generation portion. The method includes removing a sacrificial layer by etching the base from a back surface of the base, in a state in which an end covering portion of a cover layer for covering the sacrificial layer is covered with the resin layer. The method suppresses formation of a crack in the end covering portion that covers the end portion of the sacrificial layer.

16 Claims, 13 Drawing Sheets

METHOD FOR MANUFACTURING LIQUID DISCHARGE HEAD, LIQUID DISCHARGE HEAD, AND METHOD FOR MANUFACTURING LIQUID DISCHARGE HEAD SUBSTRATE

BACKGROUND OF THE INVENTION

Field of the Invention

The present disclosure relates to a method for manufacturing a liquid discharge head for discharging a liquid, a liquid discharge head, and a method for manufacturing a liquid discharge head substrate.

Description of the Related Art

An inkjet recording apparatus as a liquid discharge apparatus includes an inkjet recording head as a liquid discharge head. The inkjet recording apparatus performs recording by discharging liquid ink from the inkjet recording head, and applies the ink onto a record medium.

The liquid discharge head includes a liquid discharge head substrate (hereinafter also referred to as the substrate) and a flow path forming member. The substrate has a silicon base, a pressure generation element, and a supply port. The pressure generation element generates pressure for discharging the liquid. The supply port supplies the liquid to a pressure generation portion corresponding to the pressure generation element. The flow path forming member has a groove that forms a flow path and a discharge port. The substrate and the flow path forming member are bonded together to form a flow path for supplying the liquid to a pressure chamber containing the pressure generation portion, as well as to the pressure generation portion.

As a method for forming the supply port passing through the silicon base, a silicon anisotropic wet etching method is known. Japanese Patent Application Laid-Open No. 10-181032 discusses this type of method, which forms the supply port with high dimensional accuracy by providing a sacrificial layer on the front surface of the base. In a case where a heater is used as the pressure generation element, a heat accumulation layer for efficiently transmitting heat to the liquid is formed on the sacrificial layer. Further, a protective layer for protecting the pressure generation element from the liquid is formed on the sacrificial layer. When the supply port is formed by the anisotropic wet etching from the back surface of the base, a cover layer for covering the sacrificial layer such as the heat accumulation layer and the protective layer functions as an etching-resistant layer for stopping progress of the etching.

Meanwhile, Japanese Patent Application Laid-Open No. 2007-160624 discusses a conceivable disadvantage. Specifically, during formation of the supply port, a crack may be formed in the protective layer located in a region inside the supply port because of warpage of the base. The warpage is caused by internal stress of the flow path forming member. To prevent such a disadvantage, Japanese Patent Application Laid-Open No. 2007-160624 discusses a configuration in which the protective layer is not provided in the region inside the supply port, and an end of the protective layer and an end of the supply port are covered with an end covering layer.

In a case where the cover layer for covering the sacrificial layer such as the heat accumulation layer and the protective layer is provided, a following undesirable situation may occur. That is, in a process of removing the sacrificial layer by etching the base to form the supply port, a crack may be formed in an end covering portion of the cover layer which covers an end of the sacrificial layer.

It can be thought that the crack may be formed in the end covering portion of the cover layer for covering the heat accumulation layer and the protective layer or the like, in the following manner. When etching is performed from the back surface of the base, warpage may occur in the base because of internal stress of, for example, the heat accumulation layer, the protective layer, and the flow path forming member provided on the front surface of the base. Here, the end covering portion of the cover layer is a part that covers a step formed by the sacrificial layer, and therefore has a film thickness less than that of a part provided on a flat surface of the base. This is because, when the cover layer is provided, gas and precursor radicals if a chemical vapor deposition (CVD) method is used, or sputtered atoms if sputtering is used, become resistant to creep and adhesion in a region near the step of the sacrificial layer.

Moreover, the heat accumulation layer and the protective layer also function as the etching-resistant layer which stops the progress of the etching, for an etchant used in forming the supply port. Therefore, the etchant may change the quality of the flow path forming member, if a crack is formed in the heat accumulation layer and the protective layer in the process of forming the supply port.

SUMMARY OF THE INVENTION

The present disclosure is directed to suppression of a possibility that a crack may be formed in the end covering portion that covers the end of the sacrificial layer.

According to an aspect of the present disclosure, a method for manufacturing a liquid discharge head including a liquid discharge head substrate and a flow path forming member, the liquid discharge head substrate having a base, a pressure generation portion provided at a front surface of the base to generate pressure for discharging a liquid, and a supply port for supplying the liquid to the pressure generation portion, and the flow path forming member forming a flow path for feeding the liquid supplied from the supply port to the pressure generation portion, includes providing a sacrificial layer on the front surface of the base, providing a cover layer at the front surface of the base, the cover layer covering the sacrificial layer and including an end covering portion for covering an end of the sacrificial layer, providing a resin layer for covering the end covering portion, providing a flow path mold member on a front surface of the cover layer and a front surface of the resin layer, providing the flow path forming member on a front surface of the flow path mold member, and removing the sacrificial layer by etching the base from a back surface of the base, in a state in which the end covering portion is covered with the resin layer, wherein, in providing the resin layer, an opening which has an area smaller than an area of the sacrificial layer viewed from a direction orthogonal to the front surface of the base, is formed in the resin layer, and a surface of a part of the cover layer which covers the sacrificial layer, is exposed from the opening.

Further features of the present disclosure will become apparent from the following description of exemplary embodiments with reference to the attached drawings.

DESCRIPTION OF THE EMBODIMENTS

Figure 11:
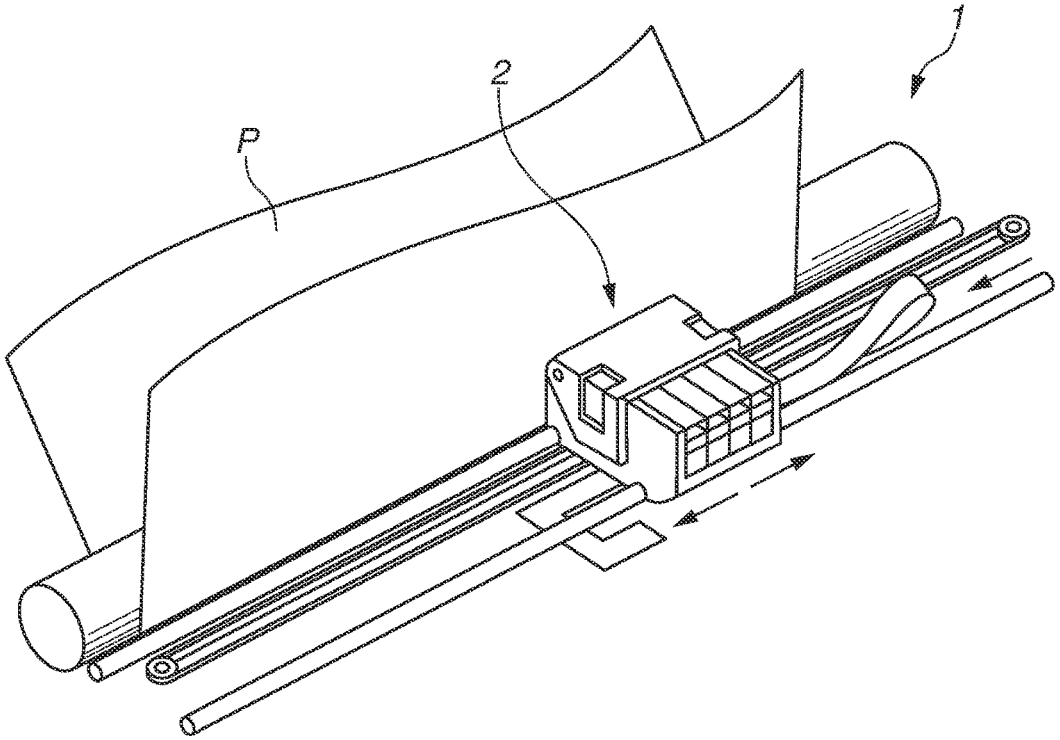
FIG. 11 is a perspective diagram illustrating a liquid discharge apparatus.
Figure 12:
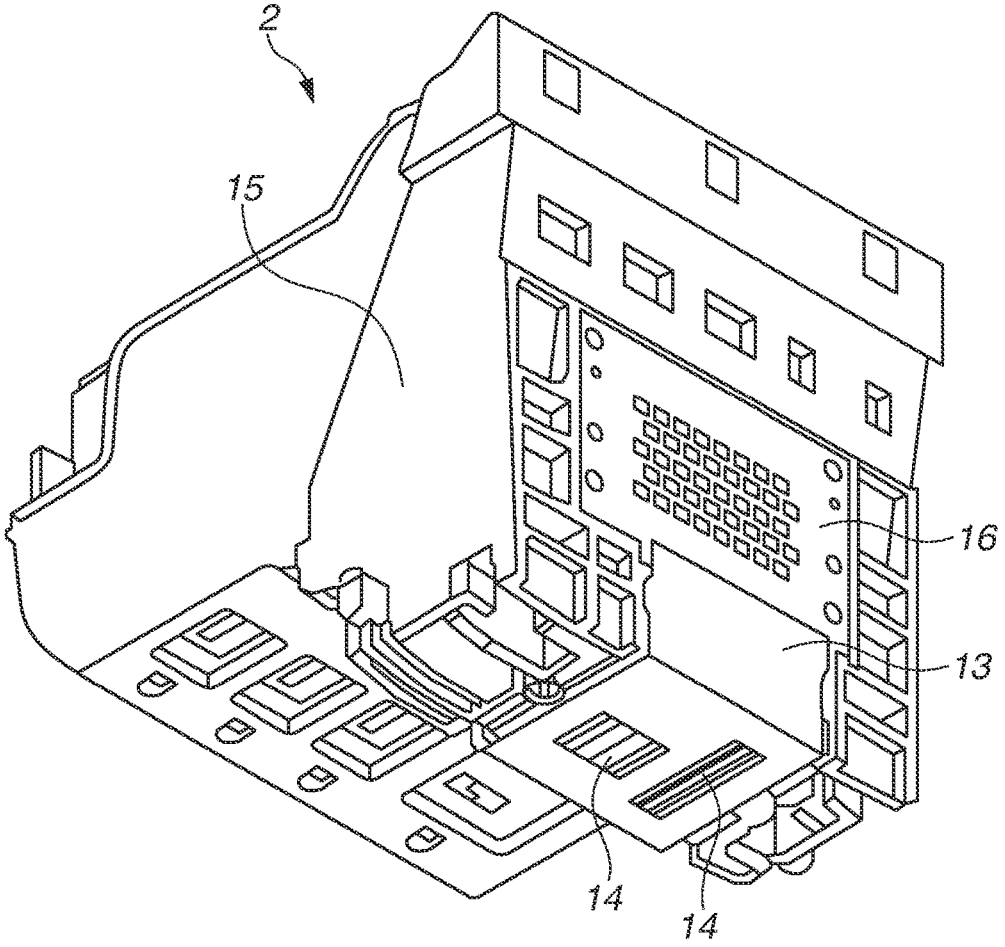
FIG. 12 is a perspective diagram illustrating a liquid discharge head unit.

FIG. 11 is a perspective diagram schematically illustrating a liquid discharge apparatus 1 (an inkjet recording apparatus) on which a liquid discharge head unit 2 is mounted, according to an exemplary embodiment. FIG. 12 is a perspective diagram illustrating an example of the liquid discharge head unit 2 to be mounted on the liquid discharge apparatus 1. The liquid discharge head unit 2 has a head housing 15, an electrical connection printed board 16, a flexible board 13, and a liquid discharge head 14. The liquid discharge head unit 2 is electrically connected to a main body of the liquid discharge apparatus 1 via the electrical connection printed board 16. The electrical connection printed board 16 and the liquid discharge head 14 are electrically connected via the flexible board 13. The head housing 15 contains a tank (not illustrated) for containing a liquid such as ink. The head housing 15 guides the liquid from the tank into the liquid discharge head 14.

Figure 13:
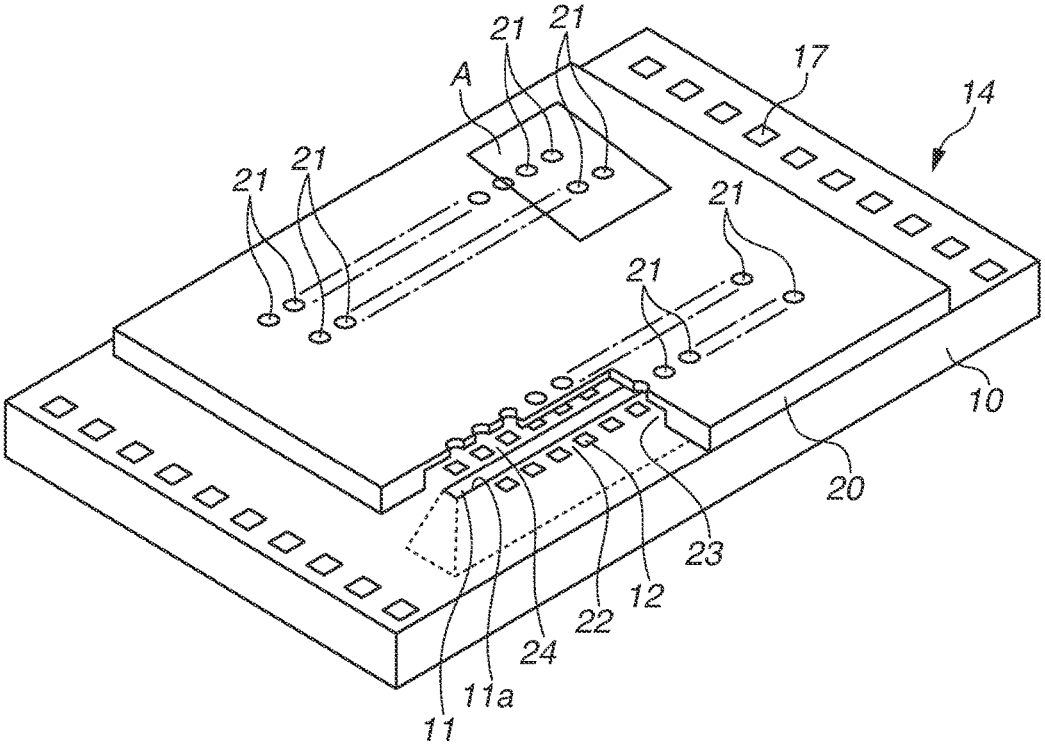
FIG. 13 is a perspective diagram illustrating a liquid discharge head.

FIG. 13 is a perspective diagram illustrating an example of the liquid discharge head 14 (an inkjet recording head) partially cut away. The liquid discharge head 14 has a liquid discharge head substrate 10 and a flow path forming member 20. The liquid discharge head 14 has a heat application portion 12 (a pressure generation portion) and a discharge port 21. The heat application portion 12 corresponds to a heater serving as a pressure generation element formed on the liquid discharge head substrate 10. The heat application portion 12 is in contact with the liquid. The discharge port 21 is formed in the flow path forming member 20. The discharge port 21 is formed at a position which corresponds to the heat application portion 12, on a surface of the flow path forming member 20. This surface faces a record medium. One or more discharge ports 21 are arranged at a predetermined pitch to form an array. Similarly, one or more heat application portions 12 are arranged at a predetermined pitch to form an array.

The liquid discharge head substrate 10 has a supply port 11 provided to pass through the liquid discharge head substrate 10. The supply port 11 is provided to supply the liquid to the heat application portion 12. Further, a bubble generation chamber 22 serving as a pressure chamber is provided to communicate with the discharge port 21 and to surround the heat application portion 12. The bubble generation chamber 22 is formed by the flow path forming member 20. The supply port 11 has an opening edge portion 11*a* shaped like a rectangle and extended in a direction of the array of the bubble generation chambers 22 and the array of the discharge ports 21.

Figure 1A:
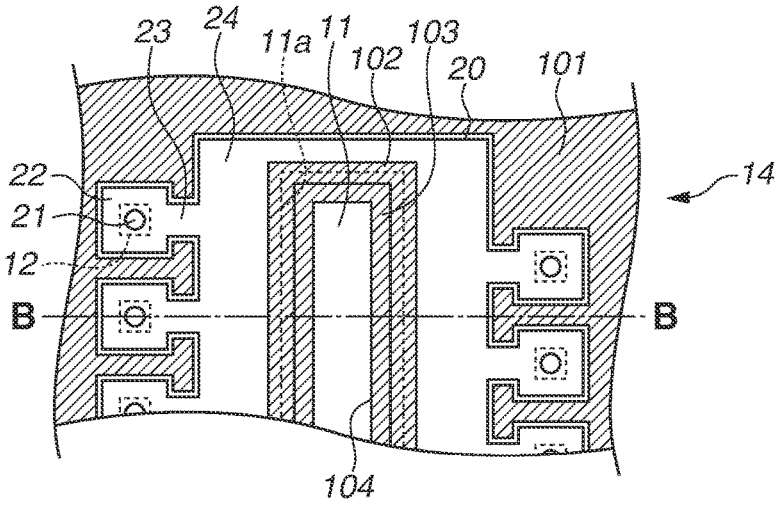
FIGS. 1A, 1B, and 1C are diagrams illustrating a liquid discharge head according to a first exemplary embodiment.
Figure 1B:
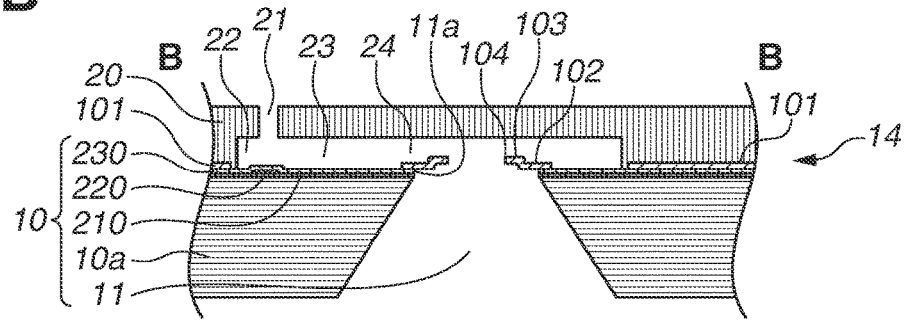

The flow path forming member 20 and the liquid discharge head substrate 10 are bonded together to form a flow path 23 and a common liquid chamber 24 (see FIGS. 1A and 1B). The flow path 23 communicates with each of the discharge ports 21. The common liquid chamber 24 retains the liquid supplied from the supply port 11, and distributes the liquid to the flow path 23. The liquid supplied through the supply port 11 is supplied to the bubble generation chamber 22 through the common liquid chamber 24 and the flow path 23.

Thermal energy generated by the heater is applied, via the heat application portion 12, to the liquid supplied into the bubble generation chamber 22. This causes film boiling, thereby generating bubbles in the bubble generation chamber 22. Bubbling pressure of these bubbles increases pressure in the bubble generation chamber 22. This applies kinetic energy to the liquid, so that a droplet is discharged from the discharge port 21. In this process, power and a drive signal are supplied from the main body of the liquid discharge apparatus 1 to the heater via a connection pad 17 provided on the liquid discharge head substrate 10, so that the heater is driven to generate the thermal energy. A dot is formed on a record medium P by discharge of a droplet from the discharge port 21 of the liquid discharge head 14 to the record medium P, so that an image is recorded on the record medium P.

Figure 1C:
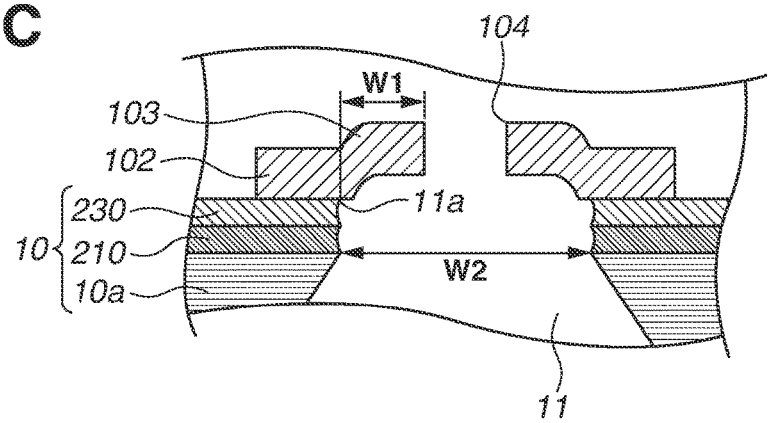
Figure 2A:
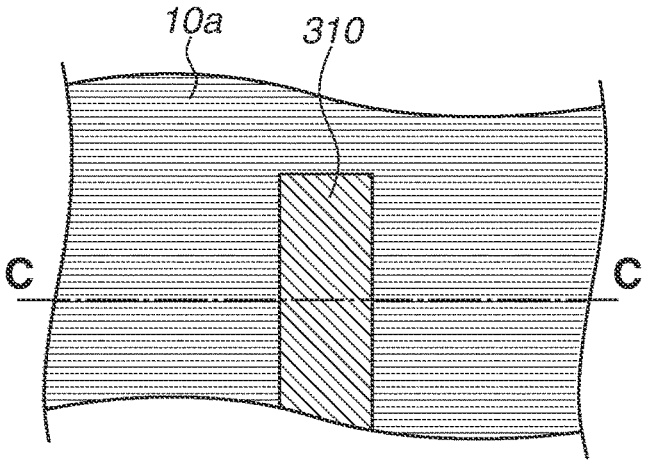
FIGS. 2A to 2D are diagrams illustrating a method for manufacturing the liquid discharge head.
Figure 2B:
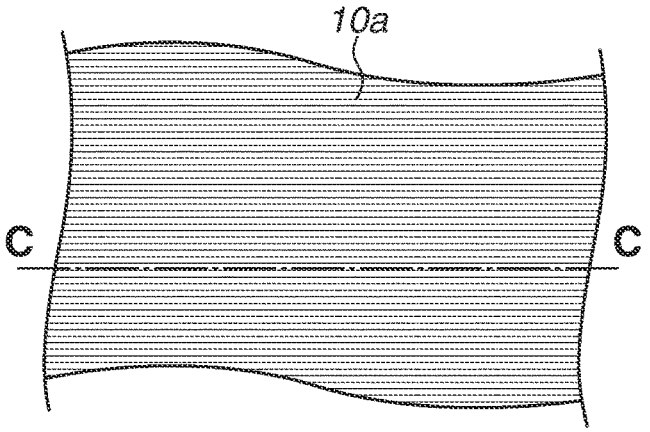
Figure 2C:
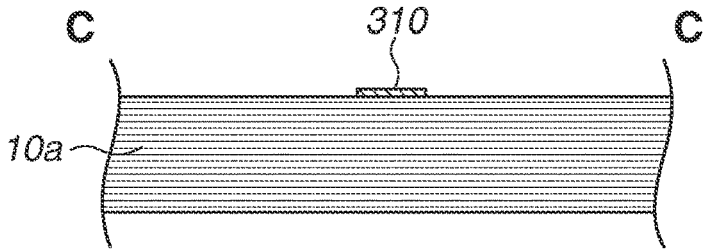
Figure 2D:
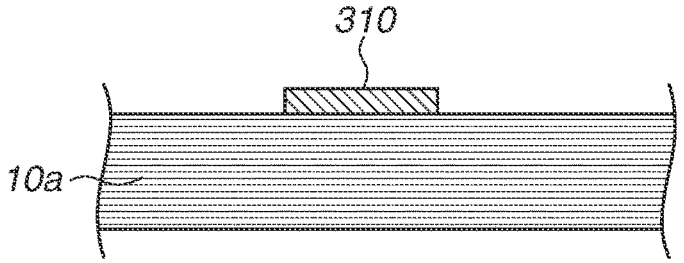

A configuration of the liquid discharge head 14 according to a first exemplary embodiment will be described. FIGS. 1A to 1C are diagrams illustrating the liquid discharge head 14 according to the first exemplary embodiment. FIG. 1A is an enlarged top view of a region A illustrated in FIG. 13. FIG. 1B is a diagram illustrating only a section taken along a B-B line illustrated in FIG. 1A. FIG. 1C is an enlarged view of a part near the supply port 11 on the front surface of the liquid discharge head substrate 10 illustrated in FIG. 1B.

A silicon base is used as a base 10*a* of the liquid discharge head substrate 10. A heat accumulation layer 210 made of a material such as silicon oxide is formed on the front surface of the base 10*a*. Elements including a heater 220 made of tantalum nitride, a switching element for driving the heater 220, and a selection circuit (not illustrated) are provided on the front surface of the heat accumulation layer 210. The heater 220 is connected to a heater electrode (not illustrated). Further, a protective layer 230 for protecting the heater 220 is formed on the front surface of the heat accumulation layer 210 and the heater 220. The protective layer 230 is made of a material such as silicon nitride. The flow path forming member 20 is formed at the front surface of the liquid discharge head substrate 10, i.e., at the front surface of the protective layer 230. The flow path forming member 20 is made of, for example, an epoxy-based resin material.

Further, an intermediate layer 101 is formed between the protective layer 230 of the liquid discharge head substrate 10 and the flow path forming member 20. The intermediate layer 101 is made of a material having more strength of adhesion to (strength of bonding with) the protective layer 230 than that of the flow path forming member 20. This can suppress peeling of the flow path forming member 20 off the liquid discharge head substrate (the protective layer 230). The intermediate layer 101 may be formed of a material having the above-described characteristic. Examples of this material include resin materials such as HIMAL (produced by Hitachi Chemical Co., Ltd.) and SU-8 (produced by Kayaku MicroChem Corporation).

Furthermore, a resin layer 102 is provided over the opening edge portion 11*a* of the supply port 11 formed on the front surface of the liquid discharge head substrate 10, as illustrated in FIG. 1A. In other words, the resin layer 102 extends above a region inside the supply port 11, when viewed from the front surface of the liquid discharge head substrate 10 (the surface, on which the flow path forming member 20 is provided, of the liquid discharge head substrate 10).

The resin layer 102 has a part contacting the front surface of the liquid discharge head substrate 10 (the front surface of the protective layer 230), and a part extending above the region inside the supply port 11 along this front surface, as illustrated in FIG. 1B. Moreover, the resin layer 102 has a step portion 103, which is closer to the flow path forming member 20 than the part contacting the front surface of the protective layer 230. The step portion 103 is formed together with an end covering portion that covers an end of a sacrificial layer 310 to be described below.

The resin layer 102 has a width of, for example, 8 μm to 12 μm. The resin layer 102 is provided to surround the opening edge portion 11*a* of the supply port 11. Specifically, the resin layer 102 has an opening having an area smaller than an opening area of the supply port 11. From the viewpoint of supplying the liquid, a width W1 of a part which is located inside the supply port 11, of the resin layer 102 is desirably about 1/30 to 1/200 of an opening width W2 of the supply port 11.

Next, a method for manufacturing the liquid discharge head 14 will be described with reference to FIGS. 2A to 2D through FIGS. 8A to 8D. FIGS. 2A, 3A, 4A, 5A, 6A, 7A, and 8A are diagrams each illustrating the region A illustrated in FIG. 13, when viewed from the front surface side of the liquid discharge head 14. The region A is partially transparent. FIGS. 2B, 3B, 4B, 5B, 6B, 7B, and 8B are diagrams each illustrating the liquid discharge head 14 when viewed from the back surface side of the liquid discharge head substrate 10. FIGS. 2C, 3C, 4C, 5C, 6C, 7C, and 8C are diagrams each illustrating only a section taken along a C-C line in the corresponding FIGS. 2A, 3A, 4A, 5A, 6A, 7A, and 8A. FIGS. 2D, 3D, 4D, 5D, 6D, 7D, and 8D are diagrams each illustrating an enlarged view of a part near the supply port 11 of the liquid discharge head substrate 10 in corresponding FIGS. 2C, 3C, 4C, 5C, 6C, 7C, and 8C.

First, as illustrated in FIGS. 2A to 2D, the sacrificial layer 310 made of, for example, aluminum is formed by sputtering, on the front surface of the base 10*a* made of silicon. The sacrificial layer 310 is configured to form the supply port 11 with high dimensional accuracy. The sacrificial layer 310 is provided at a position on the inner side of an opening region of the supply port 11 formed in a later process. Next, as illustrated in FIGS. 3A to 3D, the heat accumulation layer 210 (that has desirably a thickness of 0.5 μm to 2 μm) made of, for example, silicon oxide is formed to cover the sacrificial layer 310, by a high density plasma CVD (HDP-CVD) method. Further, the heater 220 made of, for example, tantalum nitride is formed on the front surface of the heat accumulation layer 210 by sputtering. Furthermore, the protective layer 230 (that has desirably a thickness of 0.1 μm to 0.5 μm) made of, for example, silicon nitride is formed on the front surface of the heat accumulation layer 210 and the heater 220, by a plasma CVD method.

Figure 3A:
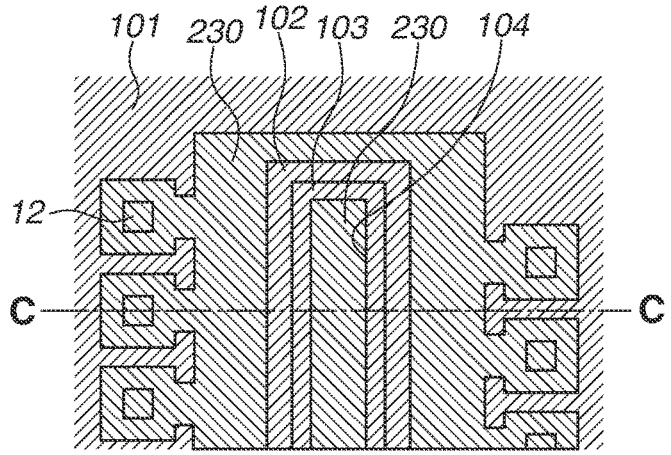
FIGS. 3A to 3D are diagrams illustrating the method for manufacturing the liquid discharge head.
Figure 3B:
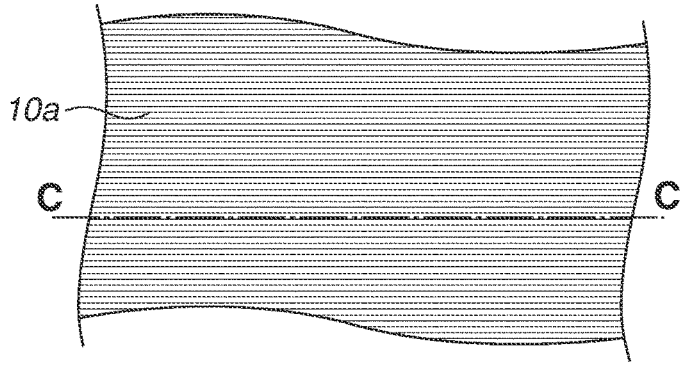
Figure 3C:
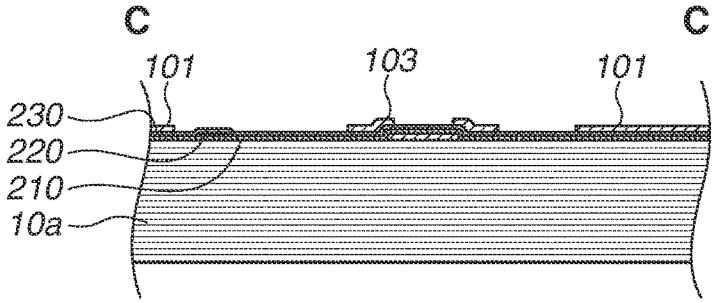
Figure 3D:
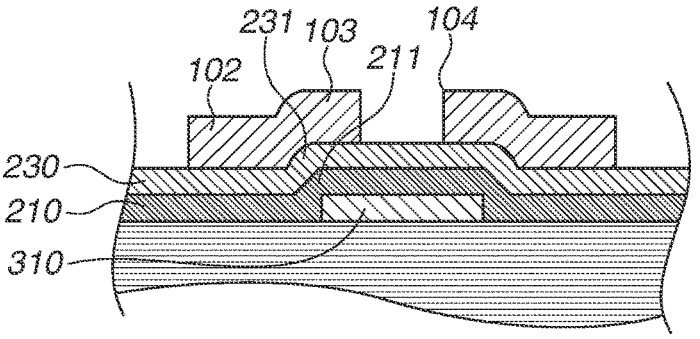
Figure 4A:
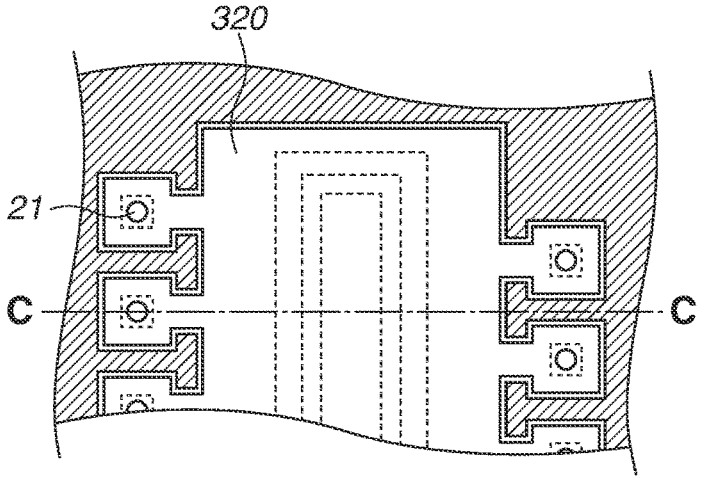
FIGS. 4A to 4D are diagrams illustrating the method for manufacturing the liquid discharge head.
Figure 4B:
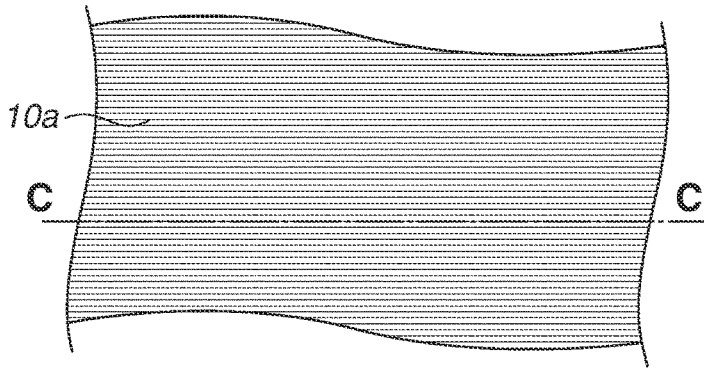
Figure 4C:
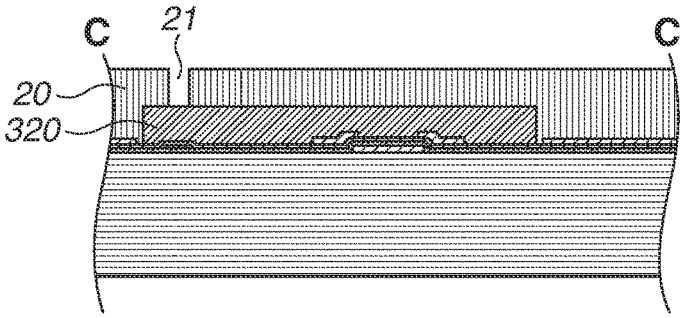
Figure 4D:
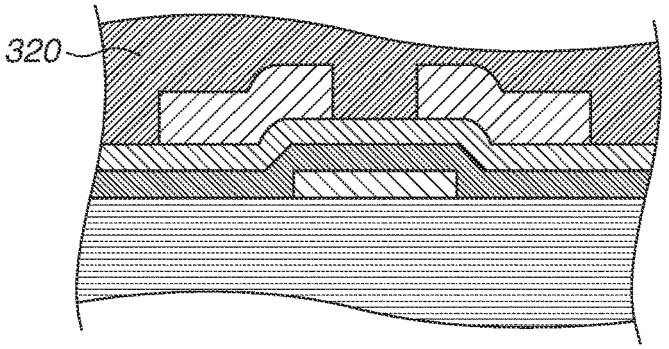
Figure 5A:
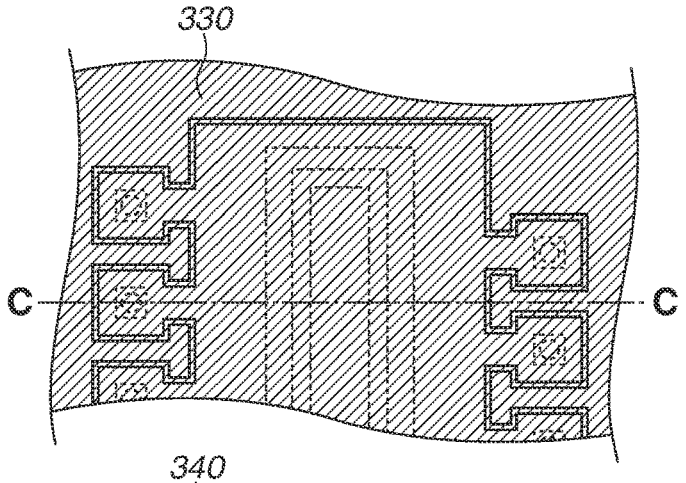
FIGS. 5A to 5D are diagrams illustrating the method for manufacturing the liquid discharge head.
Figure 5B:
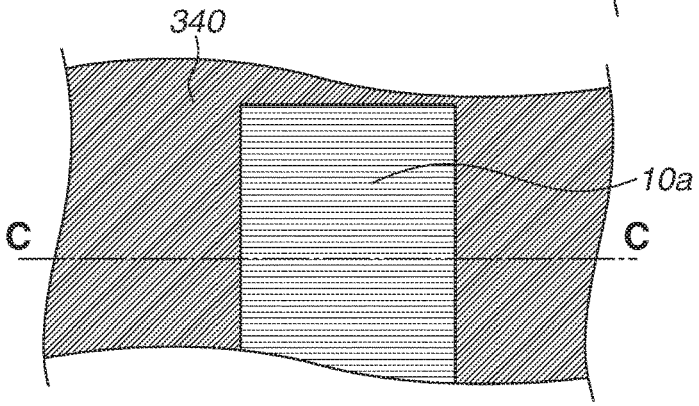
Figure 5C:
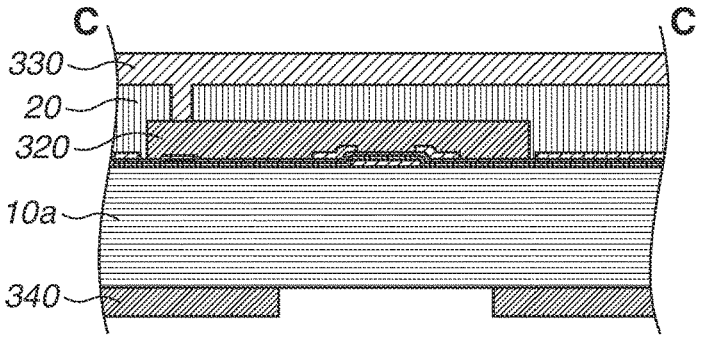
Figure 5D:
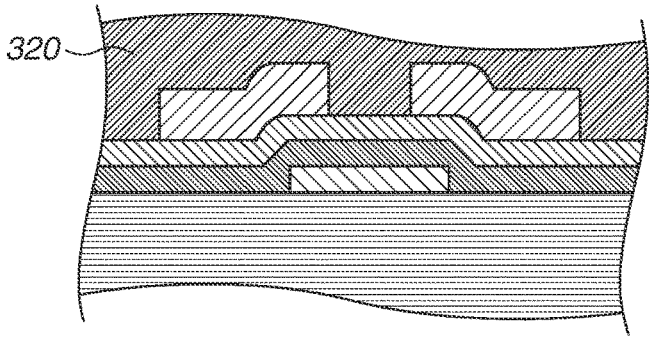
Figure 6A:
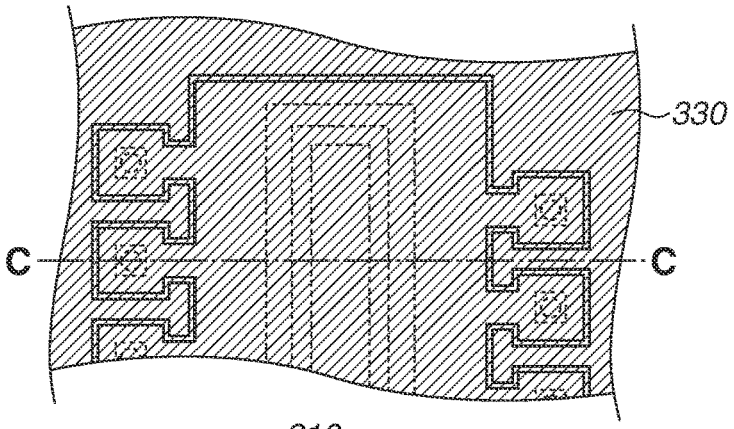
FIGS. 6A to 6D are diagrams illustrating the method for manufacturing the liquid discharge head.
Figure 6B:
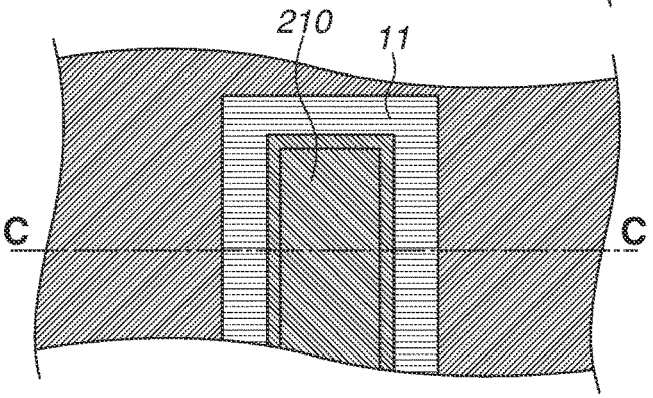
Figure 6C:
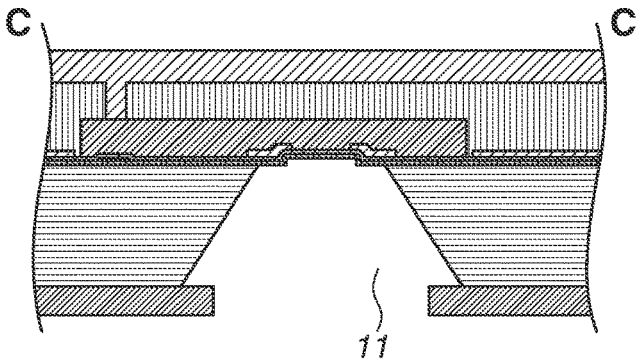
Figure 6D:
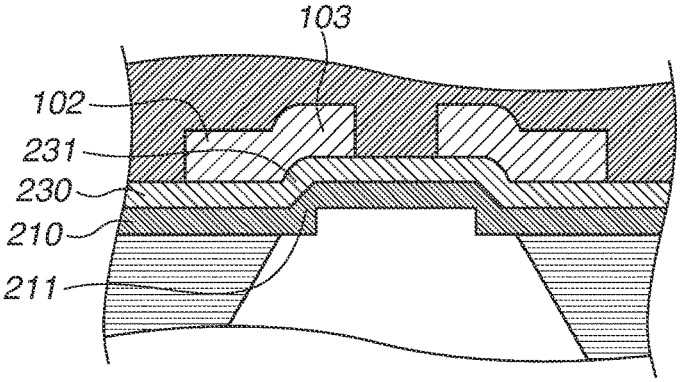
Figure 7A:
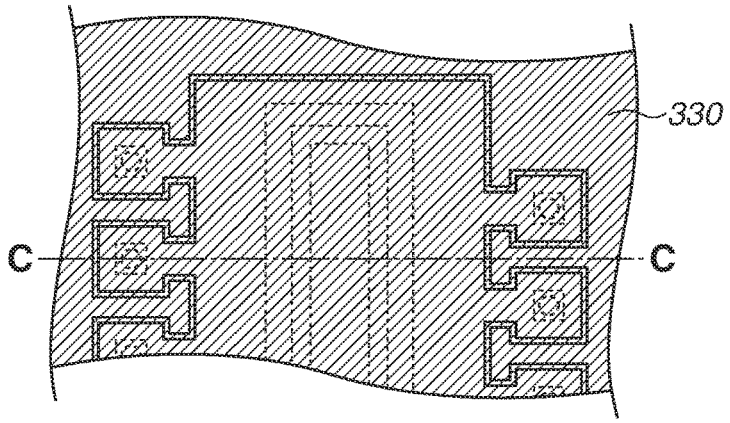
FIGS. 7A to 7D are diagrams illustrating the method for manufacturing the liquid discharge head.
Figure 7B:
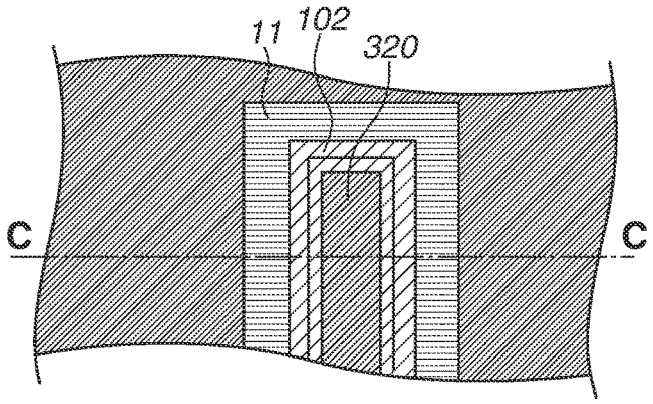
Figure 7C:
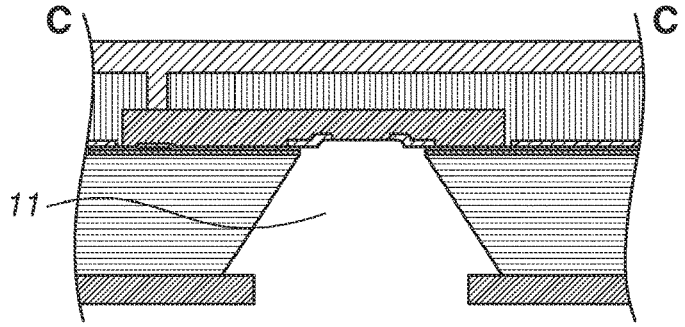
Figure 7D:
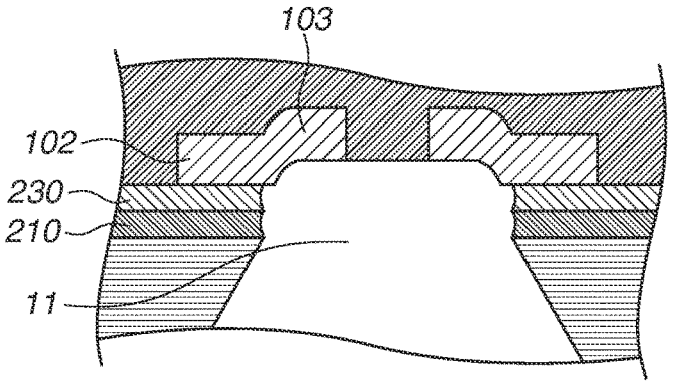
Figure 8A:
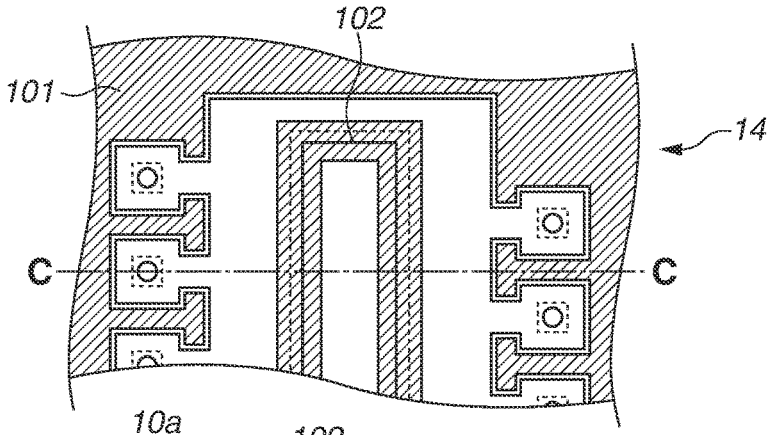
FIGS. 8A to 8D are diagrams illustrating the method for manufacturing the liquid discharge head.
Figure 8B:
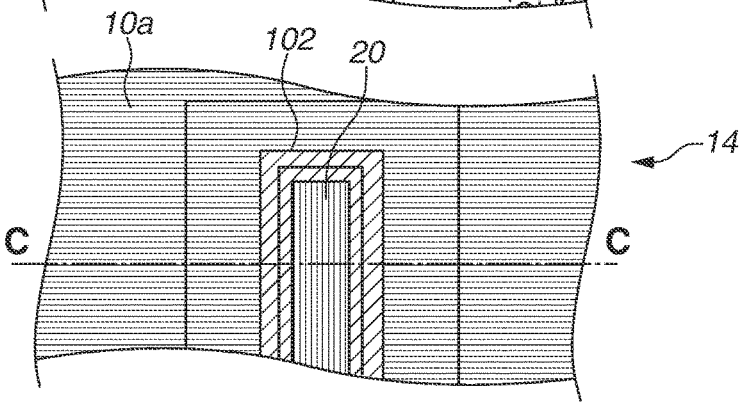
Figure 8C:
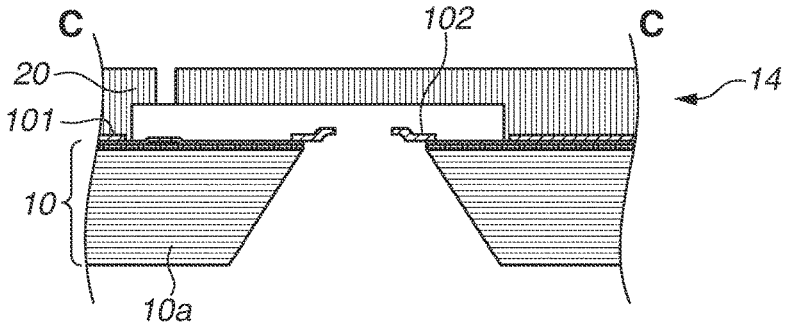
Figure 8D:
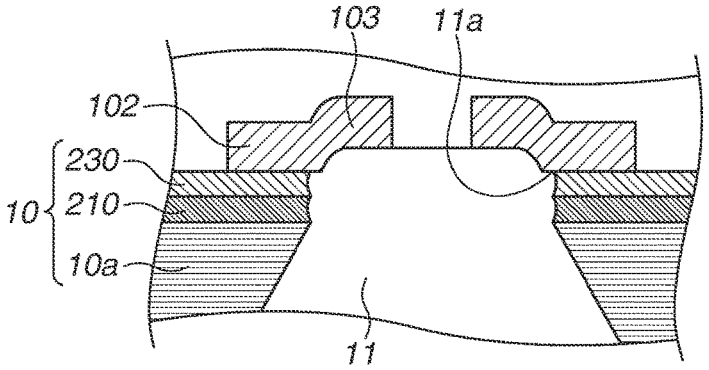

A portion 211 of the heat accumulation layer 210 and a portion 231 of the protective layer 230 cover the end of the sacrificial layer 310 (FIG. 3D). Since the portion 211 and the portion 231 cover a step formed by the sacrificial layer 310, they have a film thickness less than a part formed on a flat surface of the liquid discharge head substrate 10. The heat accumulation layer 210 and the protective layer 230 each may also be referred to as a cover layer that covers the sacrificial layer 310. In addition, the portion 211 of the heat accumulation layer 210 and the portion 231 of the protective layer 230 may also be referred to as the end covering portion that covers the end of the sacrificial layer 310. The cover layer is formed of a material including a silicon compound.

Further, the intermediate layer 101 (which has desirably a thickness of 1 μm to 4 μm) made of a polyether-amide-based resin material is formed by spin coating on the front surface of the protective layer 230 located near the heater 220. Furthermore, the resin layer 102 is formed to provide the step portion 103 that covers the portion 211 of the heat accumulation layer 210 and the portion 231 of the protective layer 230. The intermediate layer 101 and the resin layer 102 are formed as one layer by using the same material in the same process. However, the intermediate layer 101 and the resin layer 102 may be formed using different materials. In this process, an opening 104 is desirably provided in the resin layer 102. In this way, it becomes unnecessary to add a process of forming the opening 104 through which the liquid flows from the supply port 11. Since the opening 104 is provided, the front surface of a part, which covers the sacrificial layer 310, of the protective layer 230 is exposed from the opening 104. The opening 104 has an area smaller than the opening area of the supply port 11, and smaller than the area of the sacrificial layer 310 viewed from a direction orthogonal to the front surface of the liquid discharge head substrate 10.

Next, a flow path mold member 320 made of a resist material is formed by spin coating, on the front surface of the protective layer 230, the intermediate layer 101, and the resin layer 102, as illustrated in FIGS. 4A to 4D. Further, the flow path forming member 20 made of an epoxy-based resin material, for example, is formed by spin coating, on the front surface of the protective layer 230 and the front surface of the flow path mold member 320. The flow path forming member 20 can be formed using a resist material having photosensitivity. Furthermore, the discharge port 21 is formed in the flow path forming member 20 through photolithography.

Next, a front surface protective layer 330 made of a resist material is formed by spin coating, on the front surface of the flow path forming member 20 and the flow path mold member 320, as illustrated in FIGS. 5A to 5D. Further, a supply port forming mask layer 340 made of a resist material is formed by spin coating, on the back surface of the liquid discharge head substrate 10.

Next, silicon anisotropic wet etching is performed using tetramethylammonium hydroxide (TMAH) from the back surface side of the base 10*a*, by using the supply port forming mask layer 340 as a mask, as illustrated in FIGS. 6A to 6D. This process forms the supply port 11 in the base 10*a*. The sacrificial layer 310 is immediately etched and thereby removed, when TMAH reaches the sacrificial layer 310 provided at the front surface of the liquid discharge head substrate 10. This is because an etching rate of the sacrificial layer 310 made of aluminum is faster than that of the base 10*a* that is a silicon base. In this process, the heat accumulation layer 210 also functions as an etching-resistant layer for stopping the progress of the etching in regard to TMAH.

Next, a portion located in the region inside the supply port 11 of the heat accumulation layer 210 is removed by wet etching using buffered hydrogen fluoride (BHF), as illustrated in FIGS. 7A to 7D. Further, a portion located in the region inside the supply port 11 of the protective layer 230 is removed by dry etching. In this way, the supply port 11 passing through the front surface and the back surface of the liquid discharge head substrate 10 is formed.

Next, the front surface protective layer 330 and the supply port forming mask layer 340 are removed by asking and rinsing, as illustrated in FIGS. 8A to 8D. Further, the flow path mold member 320 is removed by wet etching. In this way, the liquid discharge head 14 is formed.

Here, when the base 10*a* is etched in the process of forming the supply port 11 illustrated in FIGS. 6A to 6D, warpage may occur in the base 10*a* because of internal stress of, for example, the heat accumulation layer 210, the protective layer 230, and the flow path forming member 20. In the portion 211 of the heat accumulation layer 210 and the portion 231 of the protective layer 230 which cover the end of the sacrificial layer 310 formed in the process illustrated in FIGS. 3A to 3D, a film thickness is less than a part formed on a flat surface. Therefore, in a configuration in which the resin layer 102 is not provided, a crack may be formed in the portion 211 of the heat accumulation layer 210 or the portion 231 of the protective layer 230 having relatively low rigidity when the base 10*a* is etched from the back surface. In particular, such an issue is more likely to arise if the heat accumulation layer 210 is formed using the HDP-CVD method to miniaturize a circuit, because the portion 211 of the heat accumulation layer 210 is formed further thinner than the part formed on the flat surface.

Therefore, as described above, the base 10*a* is etched to form the supply port 11, in a state in which the front surface side of the portion 211 of the heat accumulation layer 210 and the portion 231 of the protective layer 230 is covered by the resin layer 102, as illustrated in FIGS. 6A to 6D. The portion 211 of the heat accumulation layer 210 and the portion 231 of the protective layer 230 each serving as the end covering portion are therefore reinforced by the resin layer 102 during the etching of the base 10*a*. This can suppress formation of a crack. The adhering (bonding) strength of the resin layer 102 to the protective layer 230 (the cover layer) is higher than the adhering strength of the flow path mold member 320 to the protective layer 230 (the cover layer). This can provide stronger reinforcement because the resin layer 102 is brought into tight contact with the protective layer 230, as compared with a configuration of providing the flow path mold member 320 on the front surface of the protective layer 230 with no resin layer 102. The formation of a crack can be therefore suppressed.

The resin layer 102 is desirably formed in the same process as the process of forming the intermediate layer 101 disposed between the flow path forming member 20 and the liquid discharge head substrate 10. This can suppress the formation of a crack without adding more process. Further, the heat accumulation layer 210 and the protective layer 230 can be used as an etching-resistant layer during silicon anisotropic etching, by disposing the heat accumulation layer 210 and the protective layer 230 in the region inside the supply port 11.

The resin layer 102 can be formed thicker than the cover layer such as the heat accumulation layer 210 and the protective layer 230. In this way, the end covering portion of the heat accumulation layer 210 and the protective layer 230 can be more firmly reinforced by using the resin layer 102.

As for Japanese Patent Application Laid-Open No. 2007-160624, in which the protective layer is not provided inside the opening region of the supply port, it may become difficult in a manufacturing process to implement the configuration discussed therein. This is because, in a case where the protective layer is formed of a material containing a silicon compound such as silicon nitride, it may become difficult to ensure a difference in etching rate between the protective layer and the base 10*a* made of silicon, and thus process control may become difficult. In contrast, the heat accumulation layer 210 and the protective layer 230 are provided inside a region that becomes the supply port 11, before the supply port 11 is formed. It is therefore possible to suppress the formation of the above-described crack in the cover layer while adopting a simple manufacturing method.

Figure 9A:
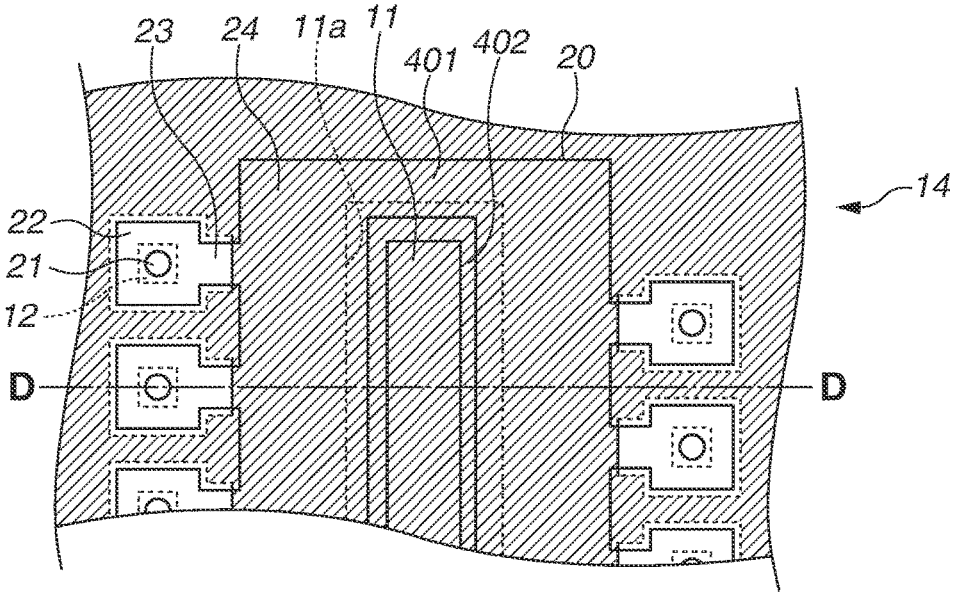
FIGS. 9A and 9B are diagrams illustrating a liquid discharge head according to a second exemplary embodiment.
Figure 9B:
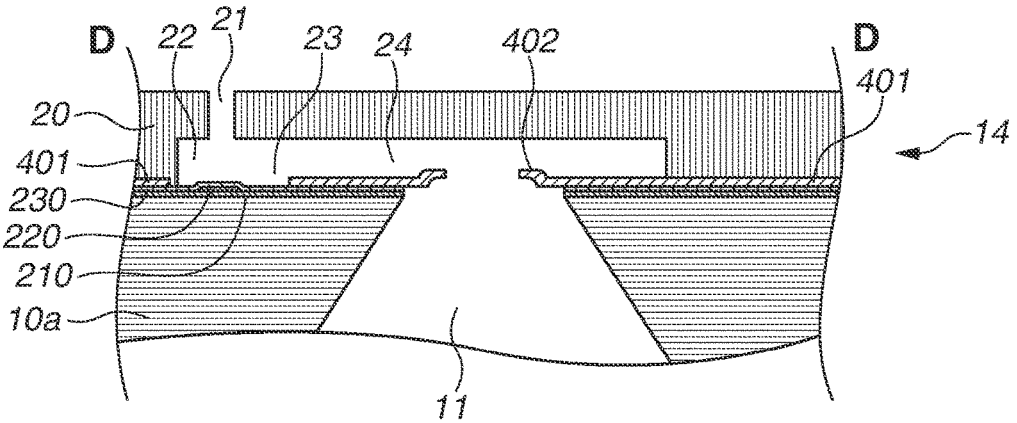

FIGS. 9A and 9B are diagrams illustrating a liquid discharge head according to a second exemplary embodiment. FIG. 9A is an enlarged top view of the region A illustrated in FIG. 13. FIG. 9B is a diagram illustrating only a section taken along a D-D line illustrated in FIG. 9A.

The second exemplary embodiment assumes a configuration in which an intermediate layer and a resin layer are formed as one layer while using the same material. Therefore, the intermediate layer and the resin layer in the first exemplary embodiment are combined and may be referred to as an intermediate layer 401. The intermediate layer 401 includes a part provided between the flow path forming member 20 and the liquid discharge head substrate (the protective layer 230), a part facing the common liquid chamber 24 (a part of the intermediate layer 401), and a part extending to the region inside the supply port 11. In addition, these parts of the intermediate layer 401 are connected to each other. The intermediate layer 401 is not provided inside the bubble generation chamber 22.

The intermediate layer 401 has a step portion 402 which comes close to the flow path forming member 20 in the region inside the supply port 11. The step portion 402 reinforces the portion 211 of the heat accumulation layer 210 and the portion 231 of the protective layer 230 in a process of forming the supply port 11. It is therefore possible to suppress the formation of a crack in these parts.

The supply port 11 may be formed to be a large port because of variations in a manufacturing process. This may locate the resin layer 102 surrounding the opening edge portion 11*a* of the supply port 11 according to the first exemplary embodiment, in the region inside the supply port 11 of the base 10*a*. In this case, the resin layer 102 may be formed to be sunk to the supply port 11, if the intermediate layer 101 and the resin layer 102 are separated, i.e., not connected to each other, as in the first exemplary embodiment.

In contrast, the intermediate layer 401 has a part formed between the flow path forming member 20 and the protective layer 230, and a part located in the region inside the supply port 11 which includes the step portion 402. These parts are formed to be connected to each other. This prevents such a situation that the entire intermediate layer 401 is located in the region inside the supply port 11 even if the supply port 11 is formed as a large port. It is therefore possible to suppress sinking of the intermediate layer 401 to the supply port 11 due to variations in manufacturing the supply port 11.

Figure 10A:
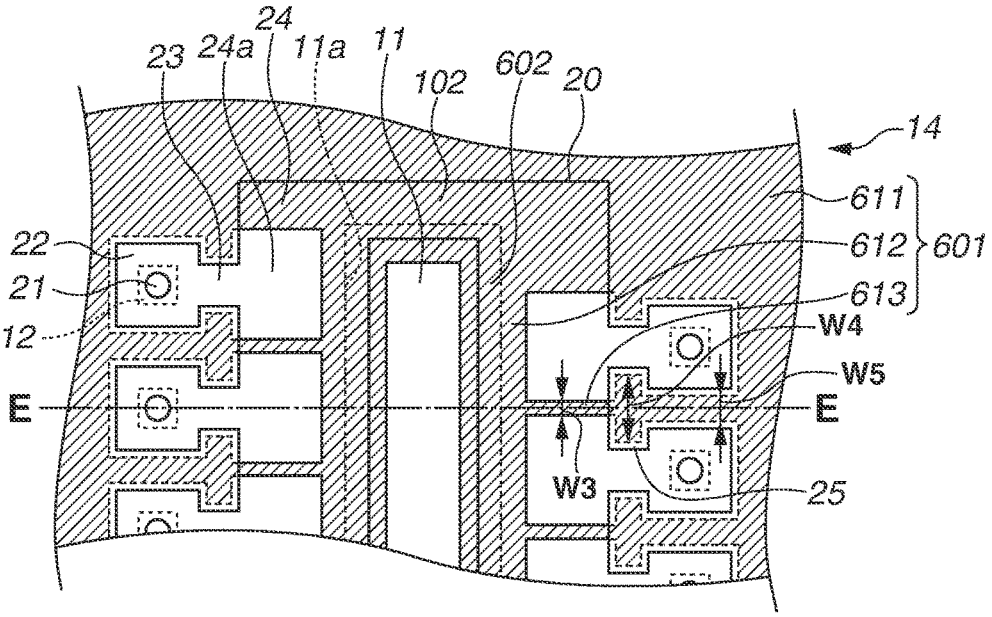
FIGS. 10A and 10B are diagrams illustrating a liquid discharge head according to a third exemplary embodiment.
Figure 10B:
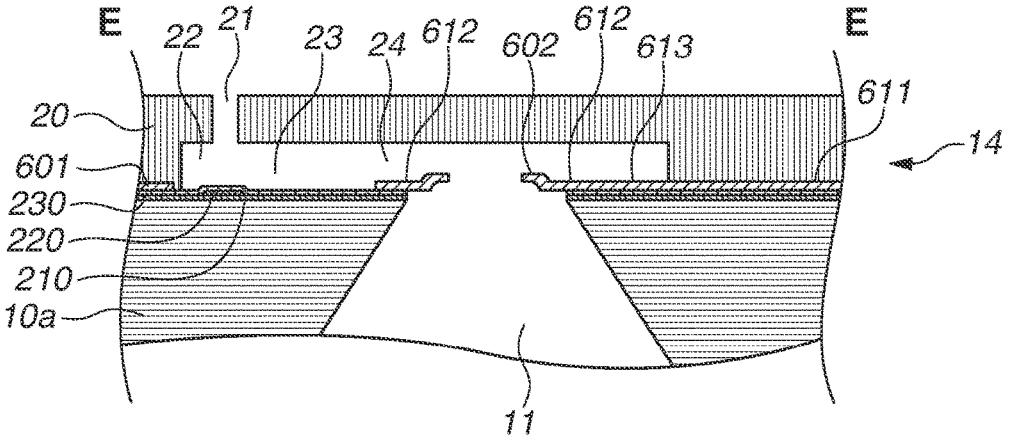

FIGS. 10A and 10B are diagrams illustrating a liquid discharge head according to a third exemplary embodiment. FIG. 10A is an enlarged top view of the region A illustrated in FIG. 13. FIG. 10B is a diagram illustrating only a section taken along an E-E line illustrated in FIG. 10A.

The third exemplary embodiment assumes a configuration in which an intermediate layer and a resin layer are formed as one layer using the same material. Therefore, the intermediate layer and the resin layer in the first exemplary embodiment are combined and referred to as an intermediate layer 601. The intermediate layer 601 has a step portion 602 which comes close to the flow path forming member 20 in the region inside the supply port 11. The step portion 602 reinforces the portion 211 of the heat accumulation layer 210 and the portion 231 of the protective layer 230 in a process of forming the supply port 11. It is therefore possible to suppress the formation of a crack in these parts.

Further, as with the second exemplary embodiment, the intermediate layer 601 has a part provided between the flow path forming member 20 and the liquid discharge head substrate 10 (the protective layer 230), a part facing the common liquid chamber 24, and a part extending to the region inside the supply port 11. In addition, these parts of the intermediate layer 601 are connected to each other. It is therefore possible to suppress sinking of the intermediate layer 601 to the supply port 11 due to variations in manufacturing the supply port 11.

Here, a part of the intermediate layer 601 formed between the flow path forming member 20 and the protective layer 230 is referred to as a first part 611. Further, a part of the intermediate layer 601 including the step portion 602 and provided over the opening edge portion 11*a* of the supply port 11 is referred to as a second part 612. Furthermore, a part of the intermediate layer 601 provided at a position facing the common liquid chamber 24 and connecting the first part 611 and the second part 612 is referred to as a third part 613. The intermediate layer 601 is not provided in the bubble generation chamber 22 and the flow path 23.

Further, the flow path forming member 20 has a wall 25 formed between the adjacent bubble generation chambers 22, and between the adjacent flow paths 23. The first part 611 is located between the wall 25 and the liquid discharge head substrate 10. The third part 613 connects the first part 611 and the second part 612 along an extending direction of the wall 25, as illustrated in FIG. 10A. The extending direction of the wall 25 is also a direction along the front surface of the liquid discharge head substrate 10 and intersecting with the array direction of the heat application portions 12. In other words, the intermediate layer 601 is not provided in a part 24*a* of the common liquid chamber 24 that communicates with the flow path 23.

In this way, in addition to the configuration of the second exemplary embodiment, a configuration is adopted which does not provide the intermediate layer 601 in the part 24*a* that communicates with the flow path 23 of the common liquid chamber 24. This can suppress an increase in resistance to the flow from the supply port 11 to the bubble generation chamber 22. Therefore, it is possible to ensure supply of the liquid to the bubble generation chamber 22, while suppressing the sinking of the intermediate layer 601 to the supply port 11.

In order to further suppress the increase in resistance to the flow, a width W3 (a length in the array direction of the heat application portions 12) of the third part 613 is desirably shorter than each of a width W4 and a width W5 of the first part 611 located between the wall 25 and the liquid discharge head substrate 10.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-150418, filed Jul. 29, 2016, which is hereby incorporated by reference herein in its entirety.

What is claimed is:

1. A method for manufacturing a liquid discharge head including a liquid discharge head substrate and a flow path forming member, the liquid discharge head substrate having a base, a pressure generation portion provided at a front surface of the base to generate pressure for discharging a liquid, and a supply port for supplying the liquid to the pressure generation portion, and the flow path forming member forming a flow path for feeding the liquid supplied from the supply port to the pressure generation portion, the method comprising: providing a sacrificial layer on the front surface of the base; providing a cover layer at the front surface of the base, the cover layer covering the sacrificial layer and including a portion for covering an end of the sacrificial layer; providing a resin layer for covering the portion of the cover layer; providing a flow path mold member on a front surface of the cover layer and a front surface of the resin layer; providing the flow path forming member on a front surface of the flow path mold member; and removing the sacrificial layer by etching the base from a back surface of the base in a state in which the portion of the cover layer is covered with the resin layer, wherein, in providing the resin layer, an opening, which has an area smaller than an area of the sacrificial layer viewed from a direction orthogonal to the front surface of the base, is formed in the resin layer, and a surface of a part of the cover layer which covers the sacrificial layer, is exposed from the opening.

2. The method according to claim 1, wherein a bonding strength of the resin layer to the cover layer is higher than a bonding strength of the flow path mold member to the cover layer.

3. The method according to claim 1, wherein an intermediate layer is provided together with the resin layer on the front surface of the liquid discharge head substrate, using a same material as a material of the resin layer, when the resin layer is provided, and the flow path forming member is provided on a front surface of the intermediate layer, when the flow path forming member is provided.

4. The method according to claim 3, wherein the resin layer and the intermediate layer having the front surface on which the flow path forming member is to be provided, are connected, when the resin layer is provided.

5. The method according to claim 4, further comprising removing the flow path mold member, and forming pressure generation portions, pressure chambers each containing the pressure generation portion, flow paths communicating with the respective pressure chambers, and a common liquid chamber allowing the flow paths and the supply port to communicate with each other, wherein, in providing the resin layer, the resin layer and a part which is to be provided with the flow path forming member on the front surface, of the intermediate layer are connected via a part which is to face the common liquid chamber, of the intermediate layer.

6. The method according to claim 5, wherein, when the resin layer is provided, the intermediate layer is not provided at a position where the pressure chamber is to be formed.

7. The method according to claim 5, wherein, when the resin layer is provided, the intermediate layer is not provided at a position which will become a part that communicates with the flow path of the common liquid chamber.

8. The method according to claim 1, wherein the resin layer made of polyether amide is provided when the resin layer is provided.

9. The method according to claim 1, wherein the resin layer thicker than the cover layer is provided when the resin layer is provided.

10. The method according to claim 1, wherein the cover layer including a silicon compound is provided when the cover layer is provided.

11. The method according to claim 1, further comprising providing a pressure generation element to form the pressure generation portion at the base, wherein the cover layer including a layer for covering the pressure generation element is provided when the cover layer is provided.

12. The method according to claim 1, wherein the removing of the sacrificial layer is started in a state in which the end of the sacrificial layer, the portion of the cover layer, and the resin layer overlap one another when viewed from the direction orthogonal to the front surface of the base.

13. A method for manufacturing a liquid discharge head substrate including a base, a pressure generation portion provided at a front surface of the base to generate pressure for discharging a liquid, and a supply port for supplying the liquid to the pressure generation portion, the method comprising:

providing a sacrificial layer on the front surface of the base;

providing a cover layer at the front surface of the base, the cover layer covering the sacrificial layer and including a portion for covering an end of the sacrificial layer;

providing a resin layer for covering the portion of the cover layer; and removing the sacrificial layer, by etching the base from a back surface of the base, in a state in which the portion of the cover layer is covered with the resin layer, wherein, when the resin layer is provided, an opening which has an area smaller than an area of the sacrificial layer viewed from a direction orthogonal to the front surface of the base, is formed in the resin layer, and a surface of a part of the cover layer which covers the sacrificial layer is exposed from the opening.

14. The method according to claim 13, wherein the resin layer made of polyether amide is provided when the resin layer is provided.

15. The method according to claim 13, wherein the resin layer thicker than the cover layer is provided when the resin layer is provided.

16. The method according to claim 13, wherein the removing of the sacrificial layer is started in a state in which the end of the sacrificial layer, the portion of the cover layer, and the resin layer overlap one another when viewed from the direction orthogonal to the front surface of the base.

* * * * *